United States Patent [19]

Garner et al.

[11] Patent Number: 4,867,243

[45] Date of Patent: Sep. 19, 1989

[54] WELLHEAD ISOLATION TOOL AND SETTING AND METHOD OF USING SAME

[76] Inventors: Jonathan W. Garner, 1120 Hunterston Hill NW., Calgary, AB, Canada, T2K 4N8; L. Murray Dallas, 524 Oakwood Place, SW., Calgary, Alberta, Canada, T2V 0K3

[21] Appl. No.: 206,205

[22] Filed: Jun. 13, 1988

[30] Foreign Application Priority Data

May 20, 1988 [CA] Canada ..... 567427

[51] Int. Cl.[4] ..... E21B 19/00; E21B 33/03; E21B 43/25

[52] U.S. Cl. ..... 66/379; 166/77

[58] Field of Search ..... 166/75.1, 77, 80, 97, 166/379, 384; 254/29 R

[56] References Cited

U.S. PATENT DOCUMENTS

| | | | |
|---|---|---|---|
| 2,927,642 | 3/1960 | Meredith et al. | 166/75.1 |
| 2,927,643 | 3/1960 | Dellinger | 166/75.1 |
| 3,830,304 | 8/1974 | Cummins | 166/305.1 |
| 4,241,786 | 12/1980 | Bullen | 166/77 |
| 4,460,039 | 7/1984 | Knight | 166/80 |
| 4,632,183 | 12/1986 | McLeod | 166/77 |

FOREIGN PATENT DOCUMENTS 1094945 2/1981 Canada .

*Primary Examiner*—Jerome W. Massie, IV
*Assistant Examiner*—David J. Bagnell
*Attorney, Agent, or Firm*—Price, Heneveld, Cooper, DeWitt & Litton

[57] ABSTRACT

A well tree isolation apparatus comprising a single hydraulic cylinder supported in axial alignment over a well tree by at least two elongated support rods. The hydraulic cylinder support rods are connected between a base plate and a hydraulic cylinder mounting plate to support the hydraulic cylinder above the well tree a distance approximately equal to the height of the production tree. The apparatus permits the insertion of a single length of high pressure tubing through any well tree, regardless of its height. Once the high pressure tubing is seated in a well tubing or casing, the hydraulic cylinder, hydraulic cylinder plate and support rods are removed to provide 360° access to a high pressure valve attached to the top of the high pressure tubing.

9 Claims, 4 Drawing Sheets

WELLHEAD ISOLATION TOOL AND SETTING AND METHOD OF USING SAME

This invention relates to the wellhead equipment of oil and gas wells, and more specifically to an improved apparatus for safely isolating wellhead equipment from the excessive pressures, abrasives and/or caustic solutions used to stimulate the production of certain oil and gas wells.

BACKGROUND OF THE INVENTION

A proportion of all oil and gas wells eventually require some form of stimulation to enhance their hydrocarbon flow and make them economically viable. Stimulation of an oil or gas well may be accomplished by several methods. One method involves pumping an acidic solution under pressure into the hydrocarbon bearing formation of a well. Another method is to hydraulically fracture the hydrocarbon bearing formations of a well. Hydraulic fracturing is the process of breaking open a hydrocarbon bearing formation by forcing into it liquids and/or gases which may be laden with abrasives. Extremely high pressures and high flow rates must be employed in the hydraulic fracturing process.

The conventional wellhead assembly, commonly called a well tree, installed on most oil and gas wells is generally not designed to withstand the pressures required to hydraulically fracture a well or, in some cases, to inject caustic fluids into a well. Most conventional well trees are designed for pressures of 21,000 kPa or less while pressures in excess of 21,000 kPa are often required in the hydraulic fracturing process. Therefore, to stimulate a well, the well tree must either be upgraded to the necessary pressure requirements or it must be isolated from the elevated pressures required for the well stimulation process.

DESCRIPTION OF THE PRIOR ART

Well tree isolation relates to isolating the wellhead equipment on a well (oil, gas or water) from the high pressures and/or high abrasive flows required for well stimulation. Wellhead equipment includes gate valves, ball valves, blowout prevention stacks, drilling spools, tubing bonnets, tubing spools, casing spools, casing bowls and all related flanges in various combinations, collectively referred to as a well tree. Generally, the well tree provides a means of safely controlling the flow from an oil, gas or water well which occurs from a hydrocarbon or water bearing formation, the product being brought to surface by means of a production tubing and/or casing.

There are several known methods of isolating well trees. All the known methods are alike in that they require the insertion of a length of high pressure tubing through the vertical passage defined by the well tree valves and flanges, the lower end of the high pressure tubing being sealed or packed off in the production tubing or casing. Each method also requires a sealing mechanism attached to the top of the well tree to prevent wellbore pressure from escaping to the atmosphere during insertion or removal of the high pressure tubing, and each requires a high pressure valve affixed to the top of the high pressure tubing to control pressure while the high pressure tubing is seated and packed off in the well tubing or casing.

The above principles of well tree isolation are common to all well tree isolation equipment, the difference in the well tree isolation methods resides in the means by which the high pressure tubing is inserted through the well tree.

There are currently three well known apparatus for inserting a high pressure tubing through a well tree. Each of these apparatus has unique advantages and disadvantages.

U.S. Pat. No. 3,830,304 issued Aug. 20, 1974, describes an apparatus having a high pressure tubing which passes longitudinally through both ends of a hydraulic cylinder and is attached to the piston thereof. The high pressure tubing can be moved up and down through the vertical passage in a well tree via the action of the piston in the hydraulic cylinder. The double acting piston movement is activated by hydraulic fluid pressure provided by a pump expressly for that purpose.

With a single hydraulic cylinder centered over the wellhead, the high pressure tubing of this apparatus is vertically aligned with the well bore to facilitate insertion and removal of the high pressure tubing from the well tree, however, movement of the high pressure tubing is limited to the stroke of the piston within the hydraulic cylinder. This limited reach prevents the efficient installation of this type of wellhead isolation equipment into certain long well trees. If a long well tree must be isolated using this equipment, the packoff nipple assembly must be removed and additional length(s) of high pressure tubing connected to the main high pressure tubing to reach the production tubing or well casing below the well tree. The packoff nipple assembly must, of course, be replaced on the end of the high pressure tubing string. The additional lengths of high pressure tubing are generally added at the work site just prior to the installation of the well tree isolation equipment. Therefore, there are often several end to end connections within the installed high pressure tubing string. These joints are susceptible to wear and erosion, especially if abrasive fluids are injected into a well, and the erosion which they cause results in a weakening of the high pressure tubing string. Since the high pressure tubing pierces the top of the hydraulic cylinder of this apparatus, the high pressure valve mounted atop the high pressure tubing is one to two meters above the top of the well tree. This makes the valve difficult to access in emergency situations and very awkward for the rigging of injection piping. As well, the entire weight of the hydraulic assembly remains on the well tree during the fracturing process, putting extra stress on the well tree, especially when hydraulic fracturing pipe and line jack occurs. "Line jack" is the high speed vibration or whipping of injection pipes or lines which occurs if a blockage develops while pumping slurries high in sand content, or when a hydraulic pump valve malfunctions. Because the high pressure tubing pierces the hydraulic piston and thereby reduces the surface area of the piston, the size of the hydraulic piston and, consequently, the hydraulic cylinder must be larger to provide adequate hydraulic power for the insertion and removal of the high pressure tubing and related packoff nipple assembly in wells with a high natural wellhead pressure, thereby increasing the size, weight and awkwardness of the well tree isolation apparatus.

Canadian patent No. 1,094,945 (Feb. 3,1981) and U.S. Pat. No. 4,632,183 (Dec. 30, 1986) teach a high pressure tubing which is harnessed to two or more hydraulic cylinders or two or more mechanical jack assemblies which are offset from the vertical passage of the well tree. The hydraulic cylinders or mechanical jacks act in unison to insert or remove a high pressure tubing through a well tree. These apparatus are advantageous in that once the high pressure tubing is set, the high pressure valve is immediately over the top of the well tree, providing relatively easy access to the valve in cases of emergency and for the rigging of injection piping. However, the length of high pressure tubing which may be inserted in a well tree by this apparatus is limited to the length of the stroke of the offset hydraulic cylinders or mechanical jacks, thereby preventing efficient entry of this style of well tree isolation equipment into certain long well trees. As described above, this short reach causes problems when long well trees must be isolated. In addition, it is difficult to coordinate the action of two or more hydraulic cylinders when inserting a high pressure tubing. If coordination between the cylinders is lost, the cylinders may work against each other and the high pressure tubing may become misaligned with the well bore, causing the tubing and packoff nipple to catch and tear on insertion. The assembly and disassembly of the two or more hydraulic cylinders and related harness of this type of apparatus is also awkward and difficult, resulting in the high pressure tubing insertion equipment being left on the well tree during the fracturing process and, thereby, creating extra stress on the well tree due to the extra weight and the high center of gravity thereof which may cause unnecessary danger, especially if hydraulic fracturing tubing and line jack occurs during the injection process.

The third known type of wellhead isolation equipment comprises a high pressure tubing attached to the hydraulic piston of a hydraulic cylinder. The hydraulic piston is pierced with a vertical bore and the high pressure tubing is welded or threaded into the lower end of the bore. The vertical bore through the piston and the bore of the high pressure tubing forms a continuous passage. Well stimulation fluids are pumped through the upper chamber of the hydraulic cylinder, the piston and the high pressure tubing into the well. The high pressure tubing can move up and down through the well tree by the action of the piston in the hydraulic cylinder. The double acting piston movement is accomplished by a series of valves which control differential pressure. To set the high pressure tubing in the well, pressure is used from the well bore. To extract the high pressure tubing from the well, independent hydraulics are used.

The advantage of this apparatus is that the single hydraulic cylinder permits good alignment of the high pressure tubing with the well bore to facilitate easy insertion and removal of the high pressure tubing. However, the apparatus has the same disadvantages of a short reach as the others described above, and therefore the same problems associated with the necessity of adding extra lengths of high pressure tubing to isolte long well trees. Because the high pressure tubing is integral with the hydraulic cylinder, access to the high pressure valve is one to two meters above the wellhead equipment and therefore difficult to access in emergency situations as well as being awkward for the rigging of injection piping. In addition, the entire weight of the hydraulic assembly remains on the wellhead during the fracturing process putting extra stress on the wellhead assembly especially when hydraulic fracturing tubing and line jack occurs during pumping. As well, sand or aggregate may become lodged in the upper chamber of the hydraulic cylinder, locking the cylinder in its extended position and preventing removal of the high pressure tubing from the well. Lastly, the tool cannot be safely set in a well bore which contains little or no natural pressure.

It is therefore an object of the present invention to provide a wellhead isolation apparatus which seeks to overcome these disadvantages of the prior art and which can easily be disassembled and transported from well to well.

A further object of the present invention is to provide an apparatus for inserting a high pressure tubing through a well tree to meet with a production tubing or casing so that fluids and/or gases can be injected into the production tubing at high pressures and flow rates without damaging the valves and flanges of the well tree.

In general terms, the present invention comprises a single hydraulic cylinder which is supported in axial alignment over the vertical passage of a well tree by two or more support rods. The high pressure tubing is therefore easily aligned with the well bore, facilitating the insertion and removal of the high pressure tubing from the well tree and eliminating the problem of opposing hydraulic cylinders working against each other. In addition, if a well tree is assembled in such a manner that the flange connections do not form a straight vertical passage, the rods supporting the hydraulic cylinder of the present invention will yield slightly to allow the high pressure tubing to realign and follow the deviations of the vertical passage of the well tree.

Upon insertion of the high pressure tubing and a successful packoff, the support rods and the entire hydraulic cylinder assembly are quickly and easily removed from the wellhead, thereby minimizing the weight and stress on the well tree and allowing completely uncluttered access to the high pressure control valve during the well stimulation treatment. This is a distinct advantage and safety feature.

Since the piston within the hydraulic cylinder of the invention is independent of the high pressure tubing, the size of the piston and cylinder may be smaller than exsiting single cylinder systems and still have more hydraulic power than double cylinder systems. This permits the insertion and removal of a high pressure tubing in well bores with natural pressures greater than existing systems can accomodate. Again, this is a safety feature which allows more controlled entry and removal of the high pressure tubing and packoff nipple assembly from well bores having a high natural well bore pressure.

The present invention also offers the unique advantage of permitting the insertion of a single length of high pressure tubing through the longest well trees while employing a single hydraulic cylinder with a finite piston stroke length. This is made possible by interchangeable rods which support the hydraulic cylinder of the well tree isolation apparatus. The support rods are provided in various lengths to accommodate various heights of well trees. As with the other apparatus heretofore described, the distance that the high pressure tubing is initially inserted through a well tree is equal to the length of the stroke of the hydraulic piston within the hydraulic cylinder.

If a length of high pressure tubing is to be inserted through a long well tree, the following procedure is adopted. At the end of each hydraulic cylinder stroke, the high pressure tubing is temporarily secured in position by attaching an adjustable stay to the high pressure valve affixed to the top of the high pressure tubing. The piston rod is disconnected from the high pressure valve and the hydraulic piston is reversed to the top of the cylinder. An extension is added to the end of the piston rod and attached to the high pressure valve. The high pressure tubing can then be inserted one more hydraulic cylinder stroke length through the well tree. This "stair-stepping" technique permits the insertion of a single length of high pressure tubing through the vertical passage of a well tree regardless of the height of the well tree. We have successfully employed this method on several occasions where the other types of wellhead isolation equipment would have failed to achieve a packoff. As a result, only one tubing connection is required in the high pressure tubing string. This connection is located where the high pressure tubing joins the high pressure control valve. Thus uneven erosion in the high pressure tubing is minimized when abrasive mixtures are pumped into a well.

In more specific terms, the invention comprises an apparatus for injecting fluids, gases, solid particles or mixtures thereof through a well tree having a vertical passage therethrough and including at least one valve and into a well having a production tubing or a well casing aligned with said vertical passage, said apparatus comprising:

(a) a hydraulic cylinder;
(b) a piston movable within said hydraulic cylinder;
(c) a piston rod fixed to said piston and movable with said piston;
(d) a length of high pressure tubing positioned in axial alignment with said vertical passage, piston rod, and hydraulic cylinder; and mounted for corresponding movement with said piston and said piston rod;
(e) a high pressure valve located upon said high pressure tubing to selectively stop fluid flow through said high pressure tubing;
(f) sealing means adapted to prevent passage of fluids and gases from the exterior of said high pressure tubing and the interior of said vertical passage to atmosphere when said high pressure tubing is inserted into said vertical passage;
(g) second sealing means adapted to prevent the passage of fluids and gases from the interior of said high pressure tubing and the interior of said production tubing or said well casing to said vertical passage when said high pressure tubing is inserted within either said tubing or said casing;
(h) at least two elongated hydraulic cylinder support rods fixed relative to said well tree in a position parallel with and offset from said vertical passage and adapted to support said hydraulic cylinder, piston and piston rod in vertical and axial alignment with said vertical passage, said support rods, hydraulic cylinder, piston and piston rod being removable from said well tree when said high pressure tubing is operatively located within said vertical passage; and
(i) hold down means for detachably securing said high pressure tubing and said high pressure valve to said well tree;

DESCRIPTION OF THE DRAWINGS

A preferred embodiment of the invention will now be described by way of example only and with reference to the following drawings wherein.

DETAILED DESCRIPTION OF THE PREFERRED EMBODIMENT

Figure 1:
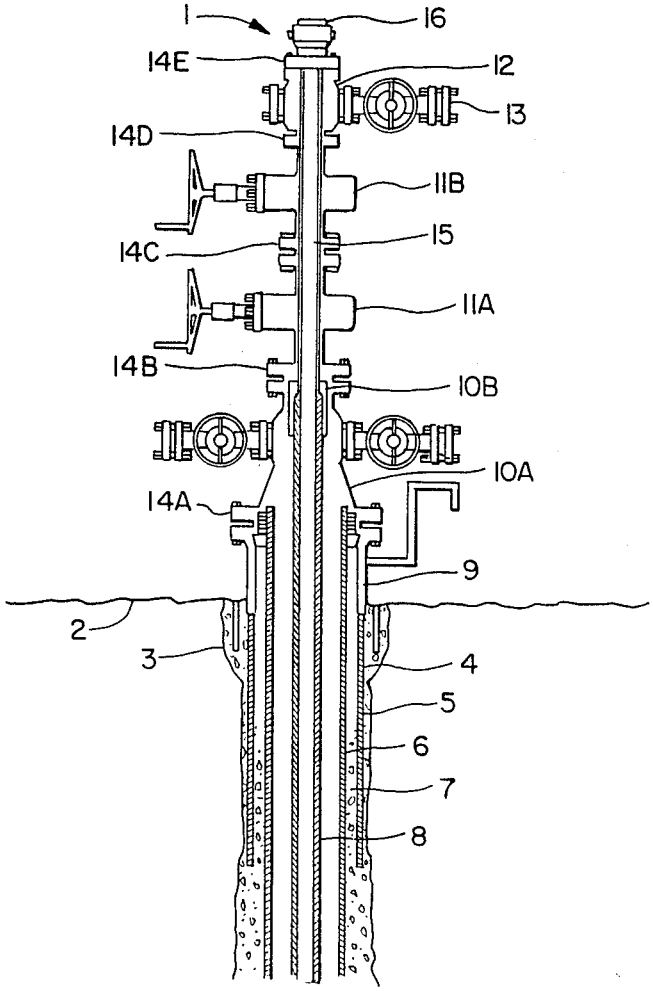
FIG. 1 illustrates a partially cutaway side view of a conventional wellhead and well tree.

Referring to FIG. 1, the well tree of a typical producing oil or gas well is indicated generally at 1. The ground surface is shown at 2. The well bore itself, only an upper portion of which is shown, comprises a well bore 3 lined with an outer, or surface casing 4 and a production casing 6. The space between the walls of the well bore and the surface casing and/or the production casing is filled with specific kinds of oil well cement 5 and 7. Located inside the production casing 6 is the production tubing 8, through which a hydrocarbon product may be brought to the surface.

The well tree is constructed in known manner from a series of valves and related flanges. For the purpose of illustration in this drawing, three valves 11A, 11B and 13 are shown, but other valves are sometimes installed. Valves 11A and 11B are attached by flanged connection 14B to a tubing spool 10A, flanged connection 14A is attached to a casing bowl 9. Casing bowl 9 is in turn attached to the production casing 6. A tubing hanger 10B connects the production tubing 8 with the vertical passage 15 of the well tree. The functions of valves 11A, 11B and 13 of the well tree are to control flow and pressure of the product, hydrocarbons or water, from the well bore.

As is common in well trees, the vertical passage 15 passes upwardly through the entire well tree and is generally closed at the top by a cap 16 mounted on a flanged connector 14E. The passage can be blocked by closing the valves 11A or 11B. In this illustration, the passage 15 forms an upward continuation of the passage through the production tubing 8.

Valves 11A, 11B and 13 are usually not designed to withstand high pressure or corrosive substances. When it is desired to hydraulically fracture or pressurize the producing formation (not shown) by way of the production tubing 8 or casing 6, it is desirable to protect valves 11A and 11B and 13 from potential damage due to the high pressure or corrosive effects of the substances employed. It is also desirable to protect flange connections 14A, B, C, D, E, tubing spool 10A, tubing hanger 10B, and all other equipment of the well tree which form the vertical passage 15 from damage due to high pressure and from exposure to the fluids used in the fracturing process because these fluids may be strongly acidic or highly abrasive. Hydraulic fracturing fluids are typically laden with high concentrations of silica sand or bauxite related materials.

Figure 2A:
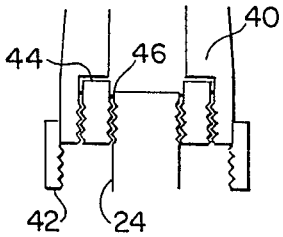
FIG. 2*a* shows a detailed cross-section of the connection between the top of the high pressure tubing and the bottom of the high pressure tubing connector illustrated in FIG. 2.
Figure 2B:
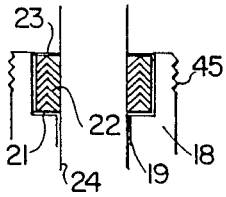
FIG. 2*b* illustrates a detailed cross section of the packing in the stuffing box housing and support rod base plate number shown in FIG. 2.
Figure 2:
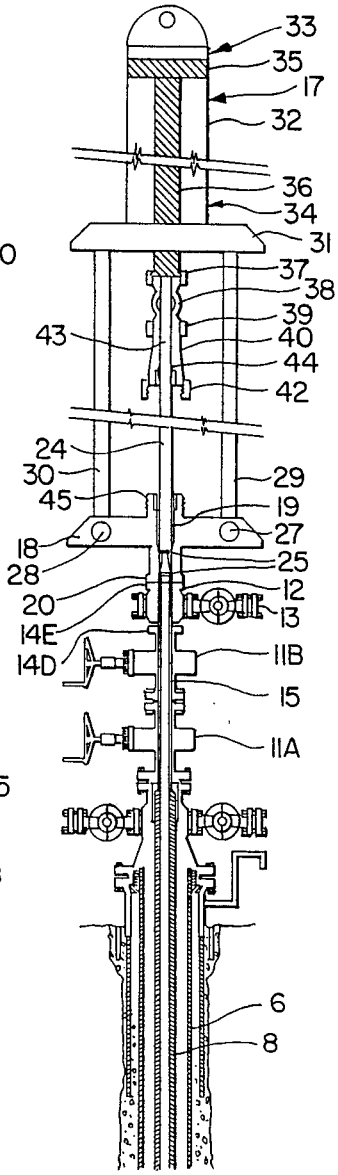
FIG. 2 shows a partially cutaway side view of the wellhead of FIG. 1 with the well tree isolation apparatus attached, the high pressure tubing having not as yet been inserted into the well tree.

FIG. 2 shows a preferred embodiment of the invention, generally indicated by 17, assembled atop the well tree. Cap 16 (see FIG. 1) has been removed from the well tree at flange 14E. In some instances, flow cross or tee 12 and wing valve 13 may be removed from the well tree at flange 14D and replaced with a flow cross or tee and a wing valve more compatible with the wellhead isolation apparatus. A stuffing box housing 45 is formed as a part of a base plate member 18 which is constructed from heavy steel plate. Base plate member 18 has a cylindrical bore 19 therethrough of a diameter equal to or larger than the vertical passage 15. Base plate member 18 is connected by means of a connecting flange 20 to the flange 14E. The connection of base plate member 18 and related apparatus as described above is accomplished while valve 11A is closed to prevent the escape of hydrocarbon from the well.

Referring to FIG. 2*b*, in the upper portion of the cylindrical bore 19 is a steel sleeve 21 and packing rings 22 constructed of brass, rubber and fabric. The steel sleeve 21 and packing rings 22 define a cylindrical bore of the same diameter as the periphery of a high pressure tubing 24 passing through bore 19. The steel sleeve and packing rings are removable and may be interchanged to accommodate different sizes of high pressure tubing 24. The steel sleeve 21 and packing rings 22 are held in the cylindrical bore 19 of the base plate member 18 by means of a retainer nut 23. High pressure tubing 24 is inserted through retainer nut 23, packing 22, sleeve 21 and cylindrical bore 19 and a packoff nipple assembly 25 is attached to the bottom end thereof prior to the connection of flange 20 to flange 14E. Conversely, if a high pressure tubing 24 is employed which already has a packoff nipple assembly 25 integral with the tubing to minimize the connections in the high pressure tubing string when pumping high abrasive flows, the top of high pressure tubing 24 is passed through the bottom of bore 19 in base plate member 18 and up through retainer sleeve 21, packing 22 and retainer nut 23. A high pressure valve connector 40 and high pressure valve 38 are then attached to the top of high pressure tubing 24 before base plate member 18 is attached to the well tree by the attachment together of flanges 20 and 14E.

Base plate member 18 extends symmetrically in a horizontal direction from cylindrical bore 19 and may be constructed as a single unit (as illustrated) or it may be constructed in two parts, the first part comprising flange 20, cylindrical bore 19 and stuffing box 45, and the second part comprising a symmetrical horizontal extension of the base plate which extends beyond the periphery of the well tree, the two parts being secured together with threaded fasteners.

At least two vertical support rods, 29 and 30 respectively, are mounted near the outside perimeter of base plate member 18 in a symmetrical pattern to provide even force distribution for a hydraulic cylinder 32. Support rods 29 and 30 are secured in place on their lower ends by pins 27 and 28 passing through the base plate member and the support rods. Alternatively, the ends of the support rods 29 and 30 may be threaded and adapted to project through holes drilled in base plate member 18 and secured by nuts or similar fasteners. Supports rods 29 and 30 are oriented to extend upwardly parallel to vertical passage 15. Support rods 29 and 30 also pass through complimentary holes drilled in a hydraulic cylinder support plate 31 and are rigidly attached to the hydraulic cylinder plate 31 by threaded fasteners (not illustrated). Hydraulic cylinder plate 31 has generally the same peripheral shape and size as base plate member 18 and the points of attachment for the support rods 29 and 30 are identically placed on member 18 and hydraulic cylinder plate 31. Hydraulic cylinder plate 31 provides the means of connecting the stabilizer rods with the hydraulic cylinder 32. The hydraulic cylinder 32 may be attached to cylinder plate 31 by means of welding, bolting or threaded engagement. Cylinder 32 is mounted in a bore in the center of hydraulic cylinder plate 31 and is oriented in axial alignment with the vertical passage 15 of the well tree.

A piston 35 is mounted for reciprocal movement in cylinder 32. Cylinder 32 is provided with two hydraulic fluid ports 33 and 34. Extending from the bottom of a piston 35 is a piston rod 36. Piston rod 36 is aligned vertically over the well tree passage 15 and reciprocates with the hydraulic movement of piston 35 under pressure from hydraulic fluid introduced through port 33 or 34. Piston rod 36 passes through the bottom of cylinder 32 by way of a sealing mechanism and through the central bore in hydraulic cylinder plate 31.

Attached to the bottom of piston rod 36 is a connector 37. Connector 37 is a threaded union or a flange adapted to attach to the top of high pressure valve 38. The bottom of high pressure valve 38 is securely attached to high pressure tubing connector 40 by means of a threaded union or flange at point 39.

High pressure tubing connector 40 is an elongated steel connector having a cylindrical bore 43 therethrough which has a diameter equal to or larger than vertical passage 15. The top of the high pressure tubing connector 40 is adapted to connect to the bottom of high pressure valve 38 by means of a threaded union or flange. The bottom of the high pressure tubing connector 40 is provided with a short cylindrical threaded bore, which has a larger diameter than the vertical passage 15 to accept a threaded sleeve 44. As shown in FIG. 2*a*, threaded sleeve 44 interconnects high pressure tubing 24 and high pressure tubing connector 40. High pressure tubing 24 is screwed into the bottom of threaded sleeve 44 and sealed thereto by means of O-ring 46 to form a rigid connection. Threaded sleeve 44 is provided in a variety of internal diameters to accomodate different sizes of high pressure tubing 24. The bottom of high pressure tubing 45 extending from base plate member 18, by means of a hold down connector comprising a threaded union or flange 42 which screws onto the housing 45. Hold down union or flange 42 must be robust enough to withstand the upward hydraulic thrust exerted on packoff nipple assembly 25 and translated upwardly through high pressure tubing 24 to high pressure tubing connector 40. In the down and set position, hold down union 42 is connected to stuffing box housing 45, each of which are illustrated as threaded unions but may be flanges or similar connectors.

Referring again to FIG. 2*b*, and as stated above, the periphery of high pressure tubing 24 is slightly smaller than the inside diameter of vertical passage 15. The lower end of tubing 24 is passed through bore 19 and sealed by means of packing material and brass packing rings 22 which are compressed by packing nut 23.

The packoff nipple assembly 25 (see FIG. 2) is attached to the bottom of high pressure tubing 24 by means of a threaded connector or may be made integral with high pressure tubing 24. The packoff nipple assembly 25 is the means by which pressure is isolated from the well tree and consists of a steel member having a bore therethrough of the same diameter as the bore of high pressure tubing 24. Attached to the circumference of the steel member of packoff nipple assembly 25 is either a permanent or a replaceable compressible rubber cup and/or a rubber sleeve. The compressible rubber cup and/or sleeve have a slightly larger outside diameter than the inside diameter of the production tubing 8 (as illustrated) or production casing 6. The packoff nipple assembly 25 may comprise more than one compressible rubber cup and/or sleeve and is designed with a taper to facilitate its insertion into the production tubing 8 (as illustrated) or the well casing.

In FIG. 2, the wellhead isolation tool is shown assembled on top of the well tree and ready for the insertion of the high pressure tubing with its packoff nipple assembly 25 through the well tree and into the production tubing 8. The apparatus is pre-assembled and hoisted into place on the well tree by means of a crane. The well tree isolation apparatus is connected to the top of the well tree at either point 14D or 14E depending on whether the wellhead flow-tee 12 (as shown) or a well tree isolation apparatus flow-tee (not illustrated) is used for the connection of the apparatus to the well tree.

Upon connection of the well tree isolation apparatus to the well tree, the valves 11A and 11B are opened to form an uninhibited vertical passage 15. High pressure valve 38 and flow control valve 13 are closed to prevent the escape of hydrocarbons and pressure from the well bore. The hydraulic cylinder is activated to slowly insert packoff nipple assembly 25 and high pressure tubing 24 down through vertical passage 15 until union 42 meets with stuffing box housing 45, at which point packoff nipple assembly 25 is seated inside production tubing 8. Union 42 is then secured to stuffing box housing 45 and valve 13 is opened to bleed off pressure in the interior of vertical passage 15. A seal between packoff nipple assembly 25 and production tubing 8 is confirmed upon stoppage of the flow from valve 13. If a long well tree is being isolated by the apparatus of the invention, a single stroke of the hydraulic piston rod 36 will not be adequate to seat the packoff nipple assembly in the production tubing. When this is the case, high pressure valve 38 is temporarily connected to an adjustable hold down (not illustrated) to hold it in position while the piston rod 36 is disconnected and hydraulic piston 35 is reversed the top of the hydraulic cylinder 32. A hydraulic piston rod extension (not illustrated) is then connected between the bottom of piston rod 36 and the top of high pressure valve 38 and the hydraulic cylinder is again activated to continue the insertion of the high pressure tubing 24. This procedure may be repeated as many times as required to complete the insertion of the high pressure tubing 24 through the well tree.

Figure 3A:
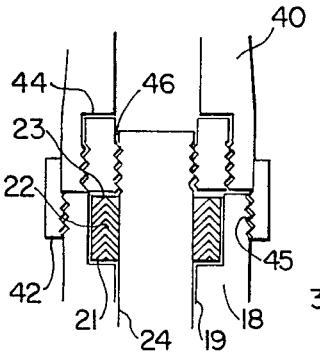
FIG. 3 is a side view of the apparatus of FIG. 2 with the high pressure tubing inserted to its final position and the packoff nipple assembly sealed in the well tubing.
FIG. 3*b* is a cross sectional detail of the threaded connection between the lower end of the high pressure tubing connector and the stuffing box housing illustrated in FIG. 3.
Figure 3:
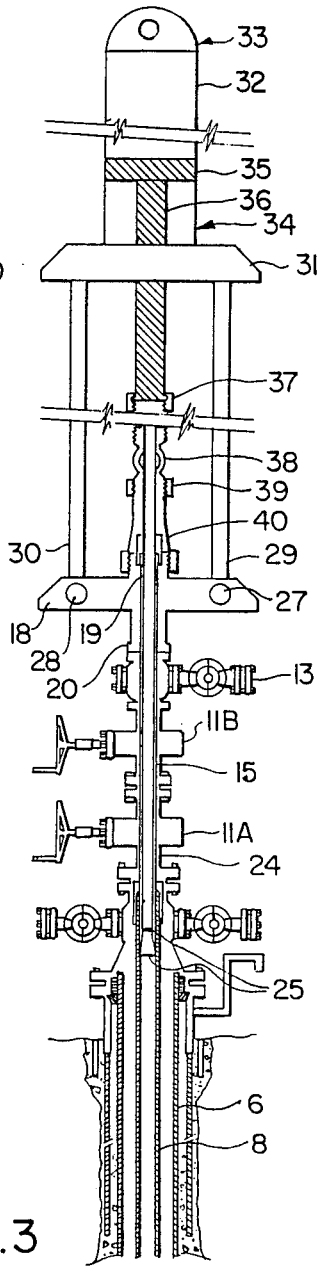

FIG. 3 shows the wellhead isolation apparatus after the high pressure tubing 24 has been inserted through vertical passage 15 of the well tree and packoff nipple assembly 25 is seated in the production tubing 8, thereby isolating pressure inside of production tubing 8 and high pressure tubing 24 from the vertical passage 15 of the well tree. Valve 13 is in the open position to bleed off pressure in the vertical passage and to ensure that a seal has been obtained. High pressure valve 38 is closed to prevent the escape of hydrocarbons from the production tubing 8 through the high pressure tubing. Winged union 42 is attached to stuffing box housing 45 and is preferably preferably a threaded union, as indicated in FIG. 3*a*. Unions 42 and 45 hold down high pressure tubing 24 so that hydraulic cylinder 32 may be removed from the well tree. Unions 42 and 45 must be sufficiently robust to resist the upward thrust exerted on the high pressure tubing 24 and the high pressure valve 38 during a well stimulation treatment.

Figure 4:
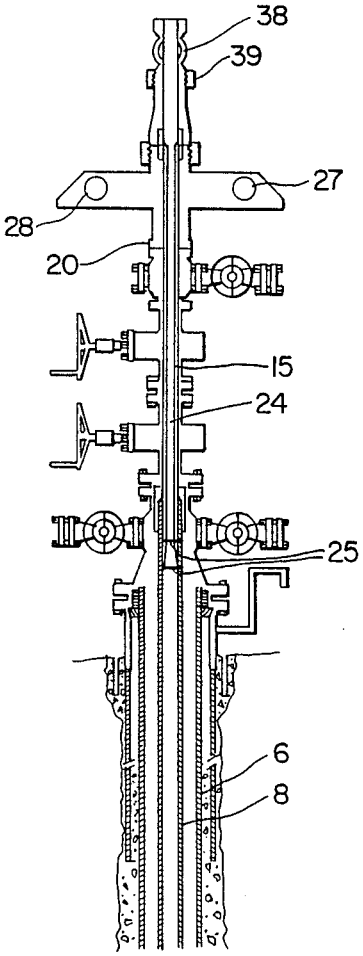
FIG. 4 is a side view of the embodiment of FIG. 2 with the well tree isolation apparatus removed, the wellhead being ready for hydraulic fracturing or other well stimulation treatment.

Connector 37 is unscrewed from the top of the high pressure valve 38 and piston rod 36 is moved upwards and away from the high pressure valve 38. The hydraulic assembly and stabilizer rods are subsequently removed from the isolated well tree by removal of pins at 27 and 28 to yield the isolated well tree as illustrated in FIG. 4. The well is now ready for hydraulic fracturing and the high pressures and flow rates which are involved. It should be noted from FIG. 4 that the well tree is now free from the encumbrance and weight of the well tree isolation apparatus. This permits 360° access to high pressure valve 38, facilitating the well simulation process and contributing significantly to the safety of the operation.

Once the well simulation treatment is completed, support rods 29 and 30, hydraulic cylinder plate 31 and hydraulic cylinder 32 are hoisted back on to the well tree and attached thereto. The high pressure tubing is removed from the well tree by reversing the procedure heretofore described for the insertion of high pressure tubing 24.

The embodiments of the invention in which an exclusive property or privilege is claimed are defined as follows:

1. An apparatus for injecting fluids, gases, solid particles or mixtures thereof through a well tree having a vertical passage therethrough and including at least one valve and into a well having a production tubing or a well casing aligned with said vertical passage, said apparatus comprising:

(a) a hydraulic cylinder;

(b) a piston movable within said hydraulic cylinder;

(c) a piston rod fixed to said piston and movable with said piston;

(d) a length of high pressure tubing positioned in axial alignment with said vertical passage, piston rod, and hydraulic cylinder; and mounted for corresponding movement with said piston and said piston rod;

(e) a high pressure valve located upon said high pressure tubing to selectively stop fluid flow through said high pressure tubing;

(f) sealing means adapted to prevent passage of fluids and gases from the exterior of said high pressure tubing and the interior of said vertical passage to atmosphere when said high pressure tubing is inserted into said vertical passage;

(g) second sealing means adapted to prevent the passage of fluids and gases from the interior of said high pressure tubing and the interior of said production tubing or said well casing to said vertical passage when said high pressure tubing is inserted within either said tubing or said casing; and (h) at least two elongated hydraulic cylinder support rods fixed relative to said well tree in a position parallel with and offset from said vertical passage and adapted to support said hydraulic cylinder, piston and piston rod in vertical and axial alignment with said vertical passage; said support rods, hydraulic cylinder, piston and piston rod being removable from said well tree when said high pressure tubing is operatively located within said vertical passage; and (i) hold down means for detachably securing said high pressure tubing and said high pressure valve to said well tree.

2. An apparatus for injecting fluids, gases and solid particles or mixtures thereof through a well tree having a vertical passage therethrough and including at least one valve and into a well having a production tubing or a well casing aligned with said vertical passage, said apparatus comprising:

(a) a hydraulic cylinder;

(b) a piston movable within said hydraulic cylinder;

(c) a piston rod fixed to said piston and movable with said piston;

(d) a length of high pressure tubing positioned in axial alignment with said vertical passage, piston rod, and hydraulic cylinder; and mounted for corresponding movement with said piston and said piston rod;

(e) a high pressure valve located upon said high pressure tubing to selectively stop fluid flow through said high pressure tubing;

(f) sealing means adapted to prevent passage of fluids and gases from the exterior of said high pressure tubing and the interior of said vertical passage to atmosphere when said high pressure tubing is inserted into said vertical passage;

(g) second sealing means adapted to prevent the passage of fluids and gases from the interior of said high pressure tubing and the interior of said production tubing or said well casing to said vertical passage when said high pressure tubing is inserted within said tubing or said casing;

(h) at least two elongated hydraulic cylinder support rods fixed relative to said well tree in a position parallel with and offset from said vertical passage and adapted to support said hydraulic cylinder, piston and piston rod in vertical and axial alignment with said vertical passage; and (i) a base plate member adapted for attachment to the top of said well tree to extend beyond the periphery thereof, said base plate member having a central vertical bore to permit the passage of said high pressure tubing and at least two opposing points of attachment for said elongated cylinder support rods, said points of attachment being equidistant from said central bore and offset from the vertical passage of said well tree;

(j) hold down means to secure said high pressure tubing and said high pressure valve to said base plate member;

(k) said hydraulic cylinder mounted upon a plate member having a central vertical bore to permit the passage of said piston rod therethrough and at least two opposing points of attachment for said elongated cylinder support rods, said points of attachments being complmentary with said points on said base plate member; and said hydraulic cylinder plate member, cylinder support rods, hydraulic cylinder, piston and piston rod being removable from said well tree after installation of said high pressure tubing therein.

3. The apparatus of claim 2 wherein said base plate member has incorporated therein said sealing means adapted to prevent the passage of fluids and gases from the exterior of said high pressure tubing and the interior of said vertical passage to atmosphere when said high pressure tubing is inserted into said vertical passage.

4. The apparatus as in claims 1 or 2 wherein said second sealing means adapted to prevent the passage of fluids and gases from the interior of said high pressure tubing and the interior of said production tubing or casing to said vertical passage when said high pressure tubing is inserted within said production tubing or casing is integral with said high pressure tubing.

5. The apparatus as in claim 1 wherein said hold down means comprises a high pressure valve connector having a vertical bore therethrough and adapted on its one end for attachment to said high pressure valve and on its opposite end for attachment to said well tree.

6. The apparatus as in claim 2 wherein said hold down means comprises a high pressure valve connector having a vertical bore therethrough and adapted on its one end for attachment to said high pressure valve and on its opposite end for attachment to said base plate member.

7. The apparatus of claims 5 or 6 wherein said high pressure valve connector is further provided with attachment means for said high pressure tubing, said attachment means comprising:

(a) a threaded bore coaxial with said vertical bore in said high pressure valve connector;

(b) a plurality of threaded sleeves, each said sleeve having an external diameter complementary with said threaded bore and an internal diameter complementary with a specific size of high pressure tubing, said sleeves being interchangeable to permit the attachment of a plurality of different diameter high pressure tubings to said high pressure valve connector; and (c) sealing means to prevent the passage of fluids and gases from the interior of said vertical bore and the exterior of said high pressure tubing to atmosphere.

8. A method of isolating a well tree located on an oil or gas well from the effects of high pressure or corrosion caused by stimulation of said well, said method comprising the steps of:

(a) inserting into the vertical passage in said well tree an assembly comprising a length of high pressure tubing with a high pressure valve located on said tubing and sealing means adapted to prevent the passage of fluids and gases from the exterior or said high pressure tubing and the interior of said vertical passage to atmosphere, and positioning upon said well tree a combination comprising a hydraulic cylinder, a piston movable within said cylinder, a piston rod fixed to said piston and movable with said piston and at least two elongated hydraulic cylinder support rods fixed relative to said well tree in a position parallel with and offset from said vertical passage and adapted to support said hydraulic cylinder, piston and piston rod in vertical and axial alignment with said vertical passage, said high pressure valve and said length of high pressure tubing;

(b) securing said hydraulic cylinder support rods to said well tree;

(c) applying hydraulic pressure to the interior of said cylinder to force said piston rod downwardly to engage said high pressure valve and tubing assembly and force said high pressure tubing down said vertical passage until said high pressure tubing is operatively located within said vertical passage and a second sealing means, affixed to the lower end of said high pressure tubing and adapted to prevent the passage of fluids and gases from the interior of said high pressure tubing and the interior of the production tubing or well casing of said well to said vertical passage, is located within the interior of said production tubing or well casing;

(d) applying a hold down means to secure said high pressure tubing and said high pressure valve to said well tree; and (e) disengaging said hydraulic cylinder support rods from said well tree and removing from said well tree said combination of said hydraulic cylinder, piston, piston rod and said support rods.

9. A method as defined in claim 8 wherein said high pressure tubing is intitially forced down by an amount determined by the stroke of said piston; said high pressure valve and tubing assembly are temporarily secured to said well tree; said piston is retracted to the top of its stroke heaving a gap between said high pressure valve and tubing assembly and said piston rod; an extension rod is located between said piston rod and said high pressure valve and tubing assembly; said high pressure valve and tubing assembly are detached from said well tree; and said piston is actuated to force said high pressure tubing further into said well tree, the foregoing steps being repeated in one or more cycles until said high pressure tubing has been forced down sufficiently to operatively locate said tubing in said vertical passage with said second sealing means located within the interior of said production well or casing.

* * * * *

UNITED STATES PATENT AND TRADEMARK OFFICE

CERTIFICATE OF CORRECTION

PATENT NO. : 4,867,243

DATED : September 19, 1989

INVENTOR(S) : Jonathan W. Garner and L. Murray Dallas

It is certified that error appears in the above-identified patent and that said Letters Patent is hereby corrected as shown below:

In the Title:

After "SETTING" insert "DEVICE".

In the Abstract, line 11:

Delete "well" and insert therefor --production--.

Column 3, line 54:

"disadvantages" should be --disadvantage--.

Column 3, line 57:

"isolte" should be --isolate--.

Column 7, line 42:

"high" should be --highly--.

Column 8, line 52:

After "tubing" insert --connector 40 is also designed to connect with the stuffing box housing--.

Column 10, line 29:

After "tubing" insert --24--.

UNITED STATES PATENT AND TRADEMARK OFFICE

CERTIFICATE OF CORRECTION

PATENT NO. : 4,867,243 PAGE 2 OF 2

DATED : September 19, 1989

INVENTOR(S) : Jonathan W. Garner and L. Murray Dallas

It is certified that error appears in the above-identified patent and that said Letters Patent is hereby corrected as shown below:

Column 11, line 63:

"complmentary" should be --complementary--.

Column 12, claim 8, line 50:

"or said" should be --of said--.

Column 14, claim 9, line 6:

"heaving" should be --leaving--.

Signed and Sealed this

Second Day of October, 1990

*Attest:*

HARRY F. MANBECK, JR.

*Attesting Officer*

*Commissioner of Patents and Trademarks*